United States Patent [19]

Zuliani

[11] Patent Number: 5,055,254

[45] Date of Patent: Oct. 8, 1991

[54] MAGNESIUM-ALUMINUM-ZINC ALLOY

[75] Inventor: Douglas J. Zuliani, Stitsville, Canada

[73] Assignee: Timminco Limited, Ontario, Canada

[21] Appl. No.: 417,563

[22] Filed: Oct. 5, 1989

[51] Int. Cl.[5] ..... C22C 23/02

[52] U.S. Cl. ..... 420/409; 148/420

[58] Field of Search ..... 420/409; 148/420

[56] References Cited

U.S. PATENT DOCUMENTS

| | | | |
|---|---|---|---|
| 2,264,309 | 12/1941 | Hanawalt et al. | 420/409 |
| 3,630,726 | 12/1971 | Fisher et al. | 420/409 |

FOREIGN PATENT DOCUMENTS

| | | | |
|---|---|---|---|
| 3242233 | 5/1984 | Fed. Rep. of Germany | 420/409 |
| 46-16247 | 5/1971 | Japan | 420/409 |
| 1382970 | 2/1975 | United Kingdom | 420/409 |

OTHER PUBLICATIONS

Hillis, James E., "Effects of Heavy Metal Contamination on Magnesium Corrosion Performance", SAE Tech. Paper Series, 830523, 1983.

Hillis, James E., "High Purity Magnesium AM60 Alloy: The Critical Contaminant Limits and the Salt Water Corrosion Performance", SAE Tech. Paper Series, 860288, 1986.

Emley, Principles of Magnesium Technology, Pergamon Press, pp. 671–685, 1966.

*Primary Examiner*—M. Dean

*Assistant Examiner*—David W. Schumaker

*Attorney, Agent, or Firm*—Nixon & Vanderhye

[57] ABSTRACT

Magnesium alloys having improved corrosion resistance, one alloy containing not more than 0.0024% iron, 0.010% nickel and 0.0024% copper and not less than 0.15% manganese and the other containing not more than 0.0015% iron, 0.0010% nickel and 0.0010% copper and not less than 0.15% manganese.

3 Claims, 2 Drawing Sheets

MAGNESIUM-ALUMINUM-ZINC ALLOY

BACKGROUND OF THE INVENTION

1. Field of the Invention this invention relates to magnesium alloys having improved corrosion resistance and, in particular, to an improved form of the alloy known commercially as AZ91, being nominally 9% Al, 1% Zn, 0.15% Mn with the balance magnesium.

2. Discussion of the Background and Description of Related Art

The ASTM specification limits for other elements appearing as impurities in the highest purity AZ9D magnesium alloy are: Fe, 0.004%; Ni, 0.001% and Cu, 0.015%. The improvement in corrosion resistance which results from maintaining the concentration of these heavy metal elements at a low level was described in U.S. Pat. No. 2,264,309 issued Dec. 2, 1941 to Hanawait et al. Hanawait points out that a "pure" alloy may have a corrosion resistance at least equal to that of magnesium alone. He goes on to state: "Such a 'pure' alloy, however, is not as workable in all aspects as the commercial alloy and further it is improbable that it could be made generally available economically" (page 1, 1st column lines 50 to 54). As discussed at pages 670–685 of "Principles of Magnesium Technology" by Emley (Pergamon Press, 1966) the existence of a "tolerance limit" was noted and when an element, typically Fe, is present in excess of this limit the corrosion rate rises rapidly. It was further noted in SAE Technical Papers Nos. 830523 and 860288 (International Congresses, Detroit, Mich., Feb. 28, 1983 and Feb. 24, 1986) that the tolerance limit for Fe is affected by the amount of the major alloying elements and, specifically, varies directly with the amount of manganese in the alloy. These tolerance limits have been incorporated into the impurity specification limits for AZ91D. The typical composition of AZ91B given in paper 830523 is a magnesium base with 8.5 to 9.5% aluminum and 0.45 to 0.9% Zn.

These publications indicate that below the tolerance limit the corrosion rate is essentially constant. Unexpectedly, it has now been found that this is not accurate and that the corrosion rate decreases in a logarithmic relationship with decreasing impurities. Based on this discovery two new alloys of differing composition, both with low concentration of heavy metal impurities, have been prepared and found to have desirably low corrosion rates.

SUMMARY OF THE INVENTION

The present invention therefore provides a magnesium alloy, having improved corrosion resistance, containing not more than 0.0024% iron, 0.0010% nickel and 0.0024% copper and not less than 0.15% manganese (hereinafter referred to as AZ91SX). In another embodiment, the invention provides an alloy of magnesium, having further improved corrosion resistance, containing not more than 0.0015% iron, 0.0010% nickel and 0.0010% copper and not less than 0.15% manganese (hereinafter referred to as AZ91UX). All proportions are by weight.

A summary of the specification limits for AZ91D and other alloys referred to in this application is set out below for convenience of reference:

| | Specification Max % | | | Min % |
|---|---|---|---|---|
| Alloy | Fe | Ni | Cu | Mn |
| AZ91D | 0.004 | 0.001 | 0.015 | 0.17 |
| AZ91X | 0.004 | 0.001 | 0.003 | 0.17 |
| AZ91SX | 0.0024 | 0.0010 | 0.0024 | 0.17 |
| AZ91UX | 0.0015 | 0.0010 | 0.0010 | 0.17 |

BRIEF DESCRIPTION OF THE DRAWINGS

The advantages of the invention will become apparent from the following discussion taken in conjunction with the attached drawings, in which.

DETAILED DESCRIPTION OF THE PREFERRED EMBODIMENTS

Figure 1:
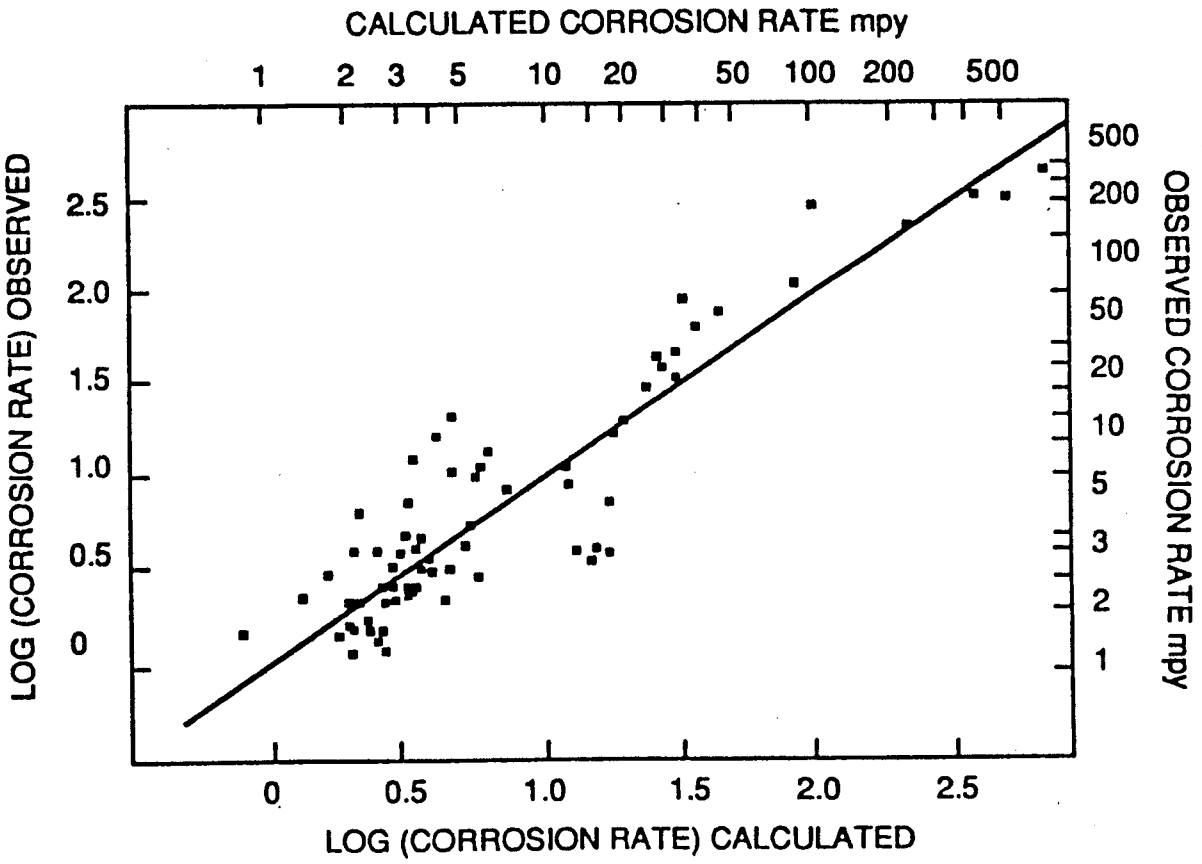
FIG. 1 shows a graph comparing the calculated and observed corrosion rate of magnesium alloy.

To demonstrate the invention, a series of magnesium alloys, ranging in heavy metal impurity levels of iron, nickel and copper were die cast into 15 cm×10 cm×0.16 cm corrosion test panels on a commercial hot chambered die casting machine. From the prior art the presence of manganese, and in particular, the ratio of iron to manganese, is known to reduce the corrosive effect of iron impurities in magnesium. Manganese was included in the test panels at a concentration of 0.15% or greater.

These panels were subjected to a rigorous examination to minimize variability in the corrosion data. The chemical composition of each visually acceptable panel was determined by removing a 5 cm portion from its bottom and spectrometrically analyzing it in three locations. The final selection of panels was made after x-ray examination to ensure the absence of porosity and such imperfections that might lead to spurious results.

Selected test panels were dimensioned, finished to a 120 grit surface, washed with deionized-distilled water, degreased and weighed. They were then suspended from a glass rod in a salt spray cabinet for a total of 240 hours in accordance with ASTM B117 standard procedures. The position of the panels was shifted periodically to ensure uniform exposure.

After exposure the panels were cleaned according to ASTM G1 standard procedures. Each panel was rinsed with distilled water, dried and cleaned of adherent corrosion products by immersion in hot 20% chromic acid plus 1% silver nitrate for 1 to 2 minutes. The panels were quickly dried and reweighed.

The corrosion rate in mils per year (mpy) was calculated with equation (1) as outlined by the ASTM G1 standard.

$$\text{Corrosion Rate (mpy)} = 3.45 \times 10^6\ W/(A \times T \times D) \quad (1)$$

where;

W is the measured weight loss in grams

A is the panel's total surface area in $cm^2$

T is the exposure time in hours

D is the density of the alloy in $gm/cm^3$

Data from this study were combined with those reported in the SAE Technical Papers, previously identified. By combining these two investigations, a single comprehensive data matrix consisting of 83 corrosion test panels was created. Table I sets out the range of compositions and corrosion rates in the combined data matrix.

TABLE I

| Study | Parameter | Investigated Range From | Investigated Range To |
|---|---|---|---|
| Current | Nickel, % | 0.0001 | 0.0014 |
| | Copper, % | 0.0001 | 0.0115 |
| | Iron, % | 0.0011 | 0.0162 |
| | Fe/Mn, — | 0.0076 | 0.0383 |
| | Corr. Rate, Mils/Yr | 0.4 | 40.0 |
| | No. of Panels | | 53 |
| Hillis et al | Nickel, % | 0.0007 | 0.0135 |
| | Copper, % | 0.0019 | 0.3040 |
| | Iron, % | 0.0012 | 0.0151 |
| | Fe/Mn, — | 0.0033 | 0.1258 |
| | Corr. Rate, Mils/Yr | 8.0 | 478 |
| | No. of Panels | | 30 |

Multiple regression analysis was used to statistically develop the best model to account for the observed effects of heavy metal impurities on the corrosion rate, shown in equation 2:

$$\log(\text{corrosion rate, mils/yr}) = 1.5657 + 0.4931 \log(\%\,Cu) + 168.8215\,(\%\,Ni) + 18.8154\,(\%Fe/\%Mn) \quad (2)$$

where

| | |
|---|---|
| $r^2 = 0.83$ | Standard Error: 0.275 |
| F Ratio: 124.85 | Degrees of Freedom: 3.79 |

FIG. 1 compares the corrosion rates calculated by equation (2) with those observed by experimentation. As indicated in this figure, the regression model fits the corrosion data over the entire range from less than 1 to in excess of 470 mils/yr.

Figure 2:
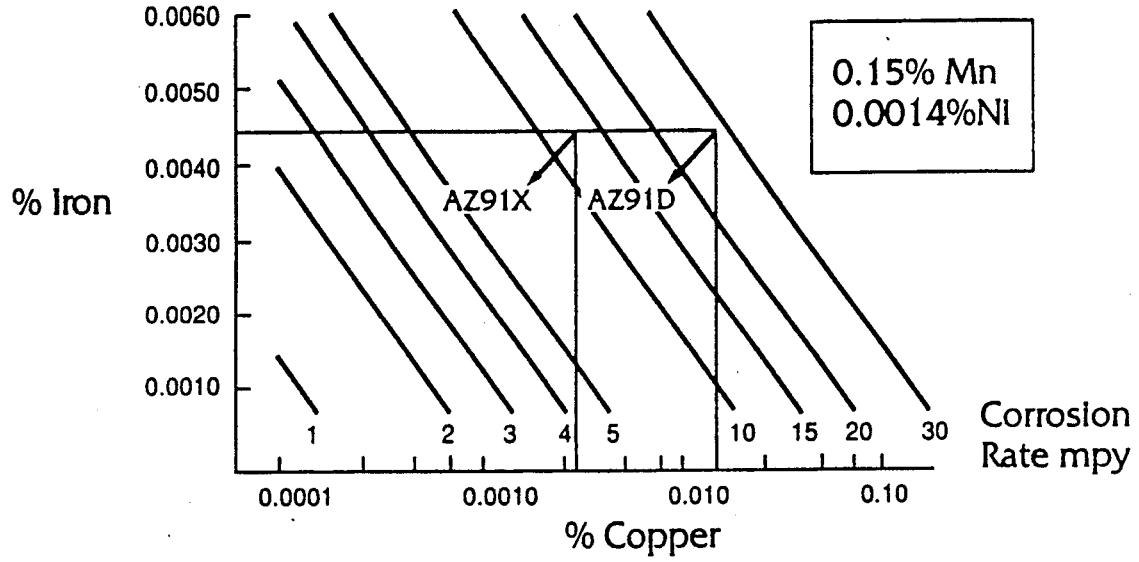
FIG. 2 shows the projected combined effects of variations in the copper and iron concentrations at a manganese concentrations equal to or greater than 0.15% and a nickel concentration of 0.0014% on the corrosion rate of magnesium alloys. The maximum expected corrosion rate of magnesium alloy AZ91D and AZ91X are shown.
Figure 3:
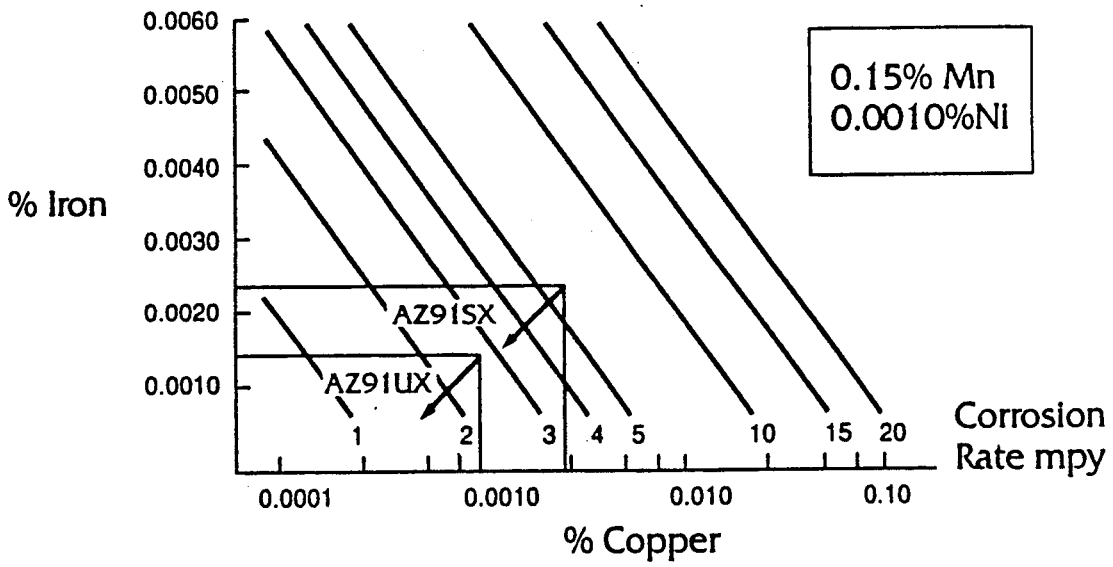
FIG. 3 shows the projected combined effects of the variations in the copper and iron concentrations at a manganese concentration equal to or greater than 0.15% and a nickel concentration of 0.0010% on the corrosion rates of magnesium alloys. The maximum expected corrosion rates of AZ91X, AZ91SX and AZ91UX are shown. Thus alloys having lower levels of impurities than those defined by the tolerance limits of ASTM specification AZ91D have been disclosed.

On the basis of this empirical equation (2), projected rates of corrosion at various concentrations of iron and copper are shown in FIGS. 2 and 3. Whereas known alloys of high purity show corrosion rates of about 14 to 28 mils/yr, the super pure (AZ91SX) and the ultra pure (AZ91UX) alloys of the present invention show corrosion rates of about 2.8 to 5.5 mils/yr.

Reference to FIG. 2 shows that simultaneously lowering the copper and iron content of AZ91 alloy leads to a beneficial result. The advantage obtained by decreasing copper concentration to such low levels has not been previously realized. FIG. 3 shows a similar advantage. Thus, simultaneously lowering the upper specification limits for iron, copper and nickel significantly decreases the anticipated maximum corrosion rate of castings made from AZ91 magnesium alloys. In addition to decreasing the absolute magnitude of the corrosion rate, lowering impurity specification limits also minimizes the expected variability in component-to-component corrosion rates.

In FIGS. 2 and 3, the identified regions represent the range of corrosion rates that can be expected for each alloy based on their impurity specification limits. The corrosion rate of each component will depend on the actual chemical composition of the primary alloy ingots which varies within the specification range.

For example, the region identified as AZ91D in FIG. 2 illustrates that, depending on the actual chemical analysis of the primary alloy ingots used by a die casting foundry, component-to-component corrosion rates could vary anywhere from a low of about 1 mil per year to, in the worst case, 28.5 mils per year.

Reducing the iron, nickel and copper impurity specification limits decreases the variability in component-to-component corrosion rates. For example, as shown by the identified regions in FIG. 3, die cast parts made from the newly developed super purity AZ91SX alloy can be expected to have corrosion rates ranging from a low of about 1 mil per year to a high of 5.5 mils per year. This range in corrosion rates is still further decreased to between about 1 to 2.8 mils per year for the ultra pure alloy (AZ91UX).

The regression analysis confirms that the Fe/Mn ratio in the casting is more highly correlated with the corrosion rate than is the iron analysis. Manganese appears to have a twofold effect, first precipitating iron to the solubility limit prior to casting the melt and, second, coating the remaining iron particles during solidification thereby inhibiting their cathodic corrosion effect in the final casting.

The solubility of manganese in AZ91 is strongly dependent on the iron content of the alloy and the melt temperature. The lower metal temperatures encountered in many die casting foundries compared to primary metal operations often leads to a significant manganese precipitation during primary ingot remelting. In this investigation, the manganese content of the die cast corrosion test panels averaged about 0.15% which represents only about 50% of the original manganese contained in the primary metal ingots.

Because of the significant precipitation of manganese that can occur during ingot remelting prior to die casting, the Fe/Mn ratio in the primary metal ingots is not a good indicator for predicting the corrosion resistance of the final casting.

Hence, even though the corrosion rate is dependent on the Fe/Mn ratio in the casting, the addition of large amounts of manganese to the primary metal will not negate the harmful effects of excessively high iron levels. In view of the propensity for manganese precipitation, reducing the iron content of the primary metal and following good foundry practice to minimize iron pickup during processing are the only effective ways of ensuring low corrosion rates.

These alloys, unexpectedly, have improved corrosion resistance demonstrating that previously held assumptions concerning appropriate tolerance limits were incorrect. It will be clear that alternatives, modifications and variations of the invention will be apparent to those skilled in the art in light of the foregoing description. Accordingly, it is intended to embrace such alternatives, modifications and variations as fall within the spirit and scope of the appended claims.

I claim:

1. A magnesium base alloy having improved corrosion resistance, consisting of about 8.5 to 9.5% aluminum, about 0.45 to 0.9% zinc, up to about 0.0024% iron, 0.0010% nickel and 0.0024% copper, and not less than about 0.15% manganese.

2. A magnesium base alloy having improved corrosion resistance, consisting of about 8.5 to 9.5% aluminum, about 0.45 to 0.9% zinc, up to about 0.0015% iron, 0.0010% nickel and 0.0010% copper, and not less than about 0.5% manganese.

3. A magnesium base alloy having improved corrosion resistnace, consisting of about 8.5 to 9.5% aluminum, about 0.5 to 0.90% zinc, up to about 0.0024% iron and 0.0024% copper, and not less than about 0.15% manganese.

* * * * *